United States Patent [19]

Little

[11] 3,974,547

[45] Aug. 17, 1976

[54] JEWELRY CLASP MEMBER

[75] Inventor: Paul V. Little, Massapequa, N.Y.

[73] Assignee: Dover Findings, Inc., Deer Park, N.Y.

[22] Filed: Nov. 11, 1975

[21] Appl. No.: 630,908

[52] U.S. Cl. ..... 24/201 BN; 24/84 B; 24/116 A

[51] Int. Cl.[2] ..... A44B 17/00; F16G 15/00; A44B 13/00

[58] Field of Search ..... 24/201 BN, 116 A, 265 CC, 24/84 B, 90 W, 116 R, 16 PB

[56] References Cited

UNITED STATES PATENTS

| | | | |
|---|---|---|---|
| 742,188 | 10/1903 | Hammond | 24/84 B |
| 1,170,582 | 2/1916 | Wardy | 24/84 B |
| 2,031,004 | 2/1936 | Pollack | 24/116 A UX |
| 2,570,680 | 10/1951 | Huizinga | 24/116 R X |
| 2,845,671 | 8/1958 | Fisher et al. | 24/84 B |
| 3,247,560 | 4/1966 | Speranza et al. | 24/265 CC X |
| 3,892,011 | 7/1975 | Kohke | 24/16 PB |

*Primary Examiner*—Donald A. Griffin
*Attorney, Agent, or Firm*—Edward H. Loveman

[57] ABSTRACT

A one-piece jewelry clasp member has a U-shaped body with two opposing flat rectangular sides and an integral curved bight at the apex of the body. A flat tab extends outwardly of the bight coplanar with one side for detachable engagement with another clasp member. This tab may have a hole or hook to engage the other clasp member. A bowed rib extends inwardly of the body integral with said one side through which a jewelry cord end may be passed and secured by flattening the rib. A slot in said one side at the rib has edges which may engage the cord end. Another hole in the bight adjacent the tab has sharp edges for cutting off the free end of the cord.

9 Claims, 12 Drawing Figures

JEWELRY CLASP MEMBER

This invention relates to the art of jewelry clasps and more particularly concerns a one-piece jewelry clasp adapted for securing one end of a cord of a necklace, bracelet or the like and for detachably engaging another clasp secured to the other end of the cord.

Numerous clasps for jewelry have heretofore been devised. Some have two or more parts. Others are assembled by soldering, screws or other attachment means. Almost all require knotting a cord to secure the cord to the clasp.

The present invention is directed at a jewelry clasp member made of a flat metal blank die cut and pressed to form a V-shaped body having flat rectangular sides and a curved apical bight. A tab for engaging another clasp member extends from the bight coplanar with one side of the clasp body adjacent to a hole in the bight. The hole has a sharp edge or edges on which a cord can be cut. The other side of the clasp body has a bowed rib extending inwardly to define a passage through which one end portion of a jewelry cord may be passed. The cord may be secured in place by flattening the bowed rib. The excess length of the cord end may be passed through the hole at the bight and cut off on the sharp edges of the hole. The tab may have a slot or hole to engage a hook portion of another clasp member. The other clasp member may have a similar clasp body for securing the other end of the cord thereto, with a tab bent to form a hook for engaging in the slot or hole in the tab of the first described clasp member. Clasp members embodying the invention may be made in miniature size, for example, as small as 3 millimeters in width and 5 millimeters in length.

Accordingly, the principal object of the present invention is to provide a one-piece jewelry clasp for securing one end of a necklace, bracelet or the like.

It is another object of the present invention to provide a one-piece jewelry clasp for securing a necklace, or bracelet having means for cutting excess length of the cord.

These and other objects and many of the attendant advantages of this invention will be readily appreciated as the same becomes better understood by reference to the following detailed description when considered in connection with the accompanying drawings in which.

Figure 2:
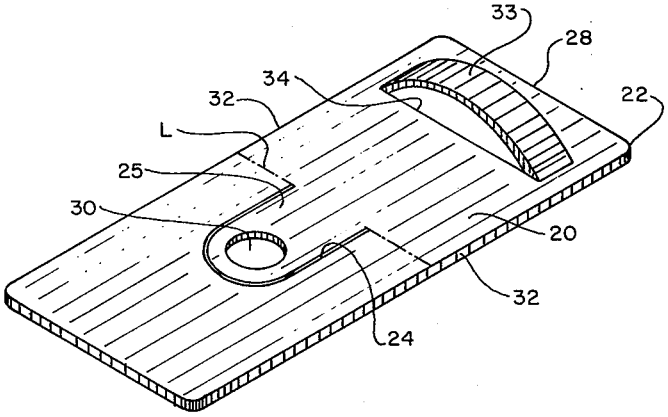
FIG. 2 is an oblique plan view of a blank from which the jewelry clasp member is formed after die cutting or punch pressing but prior to bending into V-shape.
Figure 3:
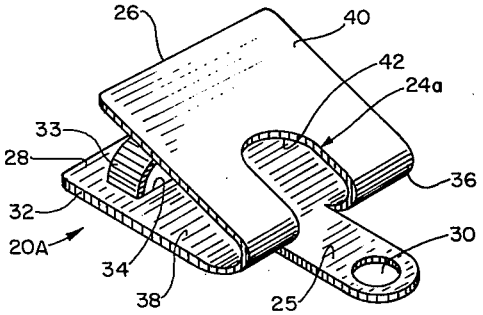
FIG. 3 is an enlarged perspective view of the clasp member after being bent to V-shape but prior to attachment of the jewelry cord thereto.

Referring now to the drawings wherein like reference characters designate like or corresponding parts throughout, there is illustrated in FIG. 2 a blank generally designated as reference numeral 20 from which a jewelry clasp member embodying the invention is made. The blank 20 has a flat rectangular body with rounded corners 22. A U-shaped cut 24 is made in the blank 20 to define a tab 25, the ends of which terminate at a line L about midway between opposite parallel, straight end edges 26, 28. A hole or slot 30 is punched out of the tab 25 near the bight of the cut 24. The hole 30 is centrally located with respect to opposite long edges 32. A bowed rib 33 is punched out of the blank 20 near the end edge 28. The rib 33 arches over a rectangular slot 34 formed in the blank 20. The blank 20 is made of a pliable metal such as brass, silver, gold or the like.

Figure 5:
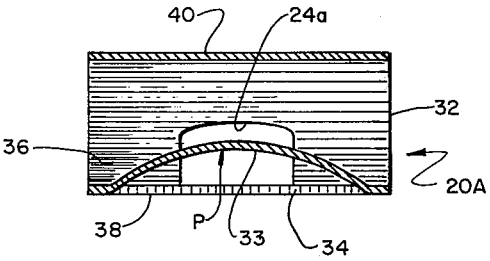
FIG. 5 is a cross sectional view taken along line 5—5 of FIG. 4.
Figure 4:
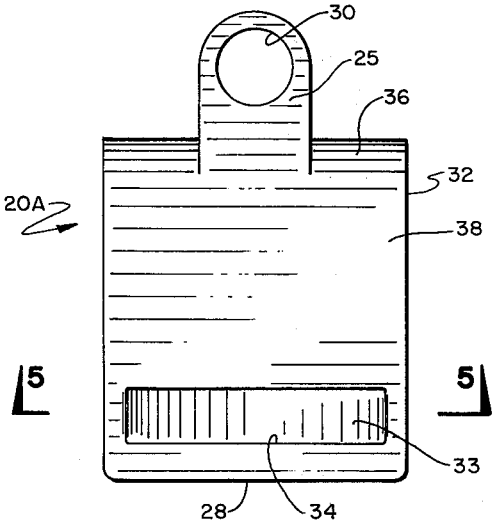
FIG. 4 is a further enlarged bottom plan view of the clasp member.
Figure 7:
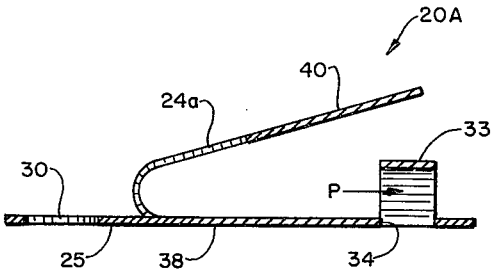
FIG. 7 is a longitudinal sectional view taken along line 7—7 of FIG. 6.
Figure 6:
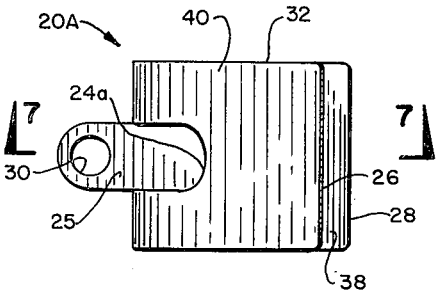
FIG. 6 is a top plan view of the clasp member, on the same scale as FIG. 4.

FIGS. 3–7 show a clasp member generally designated as reference numeral 20A formed from the blank 20. The blank 20 is bent on the line L to form a U-shaped body with a curved bight 36 and two generally rectangular sides 38, 40. The tab 25 extends outwardly of the bight 36 and coplanar with the side 38 and an adjacent hole **24*a* which has sharp edges 42. The tab 25 and the holes 24*a*, 30 are centrally located with respect to the opposite edges 32 of the clasp member 20A. The rib 33 extends inwardly and defines a passage P which is centrally aligned with the hole 24*a*** as best shown in FIG. 5.

Figure 8:
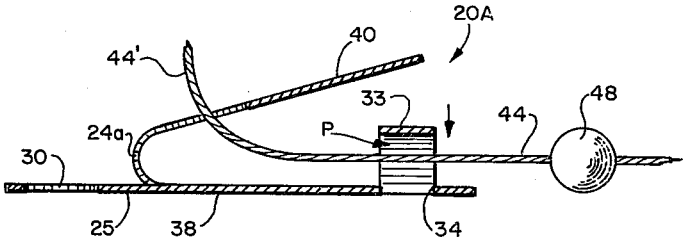
FIGS. 8, 9 and 10 are sectional views similar to FIG. 7 showing successive steps in attachment of a jewelry cord thereto.

FIG. 8 shows one end portion of a cord 44 at the end of a necklace 48 inserted into the clasp member 20A for securement thereto. The cord 44 is inserted through passage P under the rib 33 and then threaded through the hole **24*a*, with its free end 44' extending upwardly and outwardly of the bight 36**.

Figure 9:
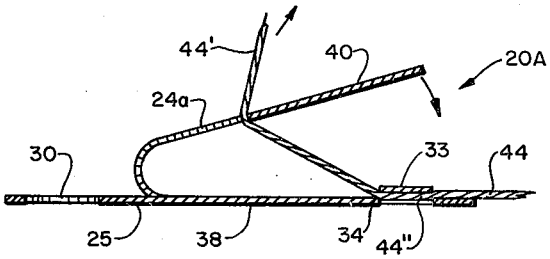

FIG. 9 shows the rib 33 flattened down on the cord 44 to engage a portion 44'' of the cord between edges of the rib 33 and edges of the slot 34. The end 44' of cord 44 is pulled taut against the edges of the hole **24*a***.

Figure 10:
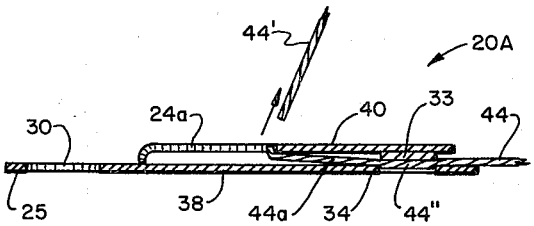

FIG. 10 shows the side 38 of the clasp member 20A pressed down parallel to the side 40. The end 44' of the cord is cut off by pulling it against the sharp edges 42 of the hole **24*a*. The side 40 overlays the cord 44 and abuts the flattened rib 33. The end 44*a* of the cord is now secured between the opposite sides 38, 40 of the clasp member 20A**.

Figure 1:
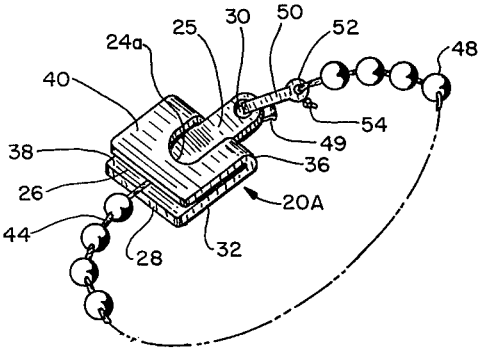
FIG. 1 is a perspective view of part of a necklace with a jewelry clasp assembly including a clasp member embodying the invention.

FIG. 1 shows the clasp member 20A to which the cord 44 of necklace 48 is secured. The clasp member 20A is removably engaged with a hook 49 of another clasp member 50. The hook 49 is inserted through the hole 30 in the tab 25. The clasp member 50 is one of conventional type with an eye 52 engaging the other end of the cord 44 by means of a knot 54 in the cord 44.

Figure 11:
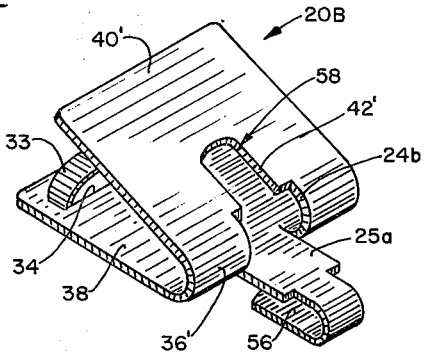
FIG. 11 is a perspective view of another clasp member embodying a modification of the invention.

FIG. 11 shows another clasp member 20B similar to the clasp member 20A with similar parts. A tab **25*a* has a narrowed end portion 56 which is bent outwardly to form a hook. The width of the end portion 56 is less than the diameter of the hole 30 in the tab 25 of the clasp member 20A to engage therein. A hole 24*b* in a side 40' has a narrowed portion 58 with sharp edges 42' left when the blank from which the clasp member 20B** is made, is bent at a bight 36' to form the V-shaped clasp member 20B shown in FIG. 11.

Figure 12:
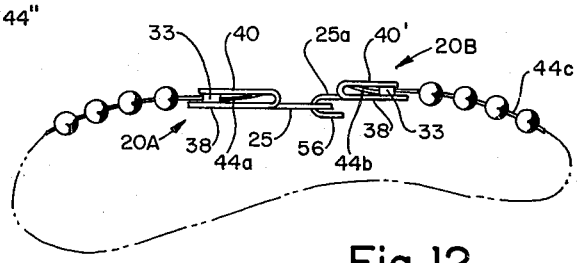
FIG. 12 is a side view of a jewelry clasp assembly on a reduced scale with clasp members of the types shown in FIGS. 3 and 11 secured to the ends of a necklace and mutually engaged with each other.

FIG. 12 shows the clasp members 20A and 20B mutually engaged with each other by insertion of the hooked portion 56 of the member 20B through the hole 30 in tab 25 of the member 20A. Opposite ends 44*a*, 44*b* of the necklace cord 44*c* are securely attached to the respective clasp members 20A and 20B which are quickly detachable by disengaging the hook 56 from the tab 25. It will be noted that no knots are required to attach the cord 44*c* to either clasp member.

In merchandising, both clasp members 20A and 20B can be packaged and sold together as a set. They can be made of any desired pliable metal. Engagement of the cord requires no special tools and no special skill.

It should be understood that the foregoing relates to only a limited number of preferred embodiments of the invention which have been by way of example only and that it is intended to cover all changes and modifications of the example of the invention herein chosen for the purposes of the disclosure, which do not constitute departures from the spirit and scope of the invention.

What is claimed is:

1. A one-piece jewelry clasp member adapted for securement to a cord of a necklace or the like comprising a U-shaped body, having two opposing generally rectangular flat sides;

a curved bight integral with said sides at the apex of said body;

a tab extending outwardly of said bight coplanar with one side of said body for detachable engagement with another clasp member; and a bowed rib extending inwardly of said body integral with said one side thereof and defining a passage with said other side, whereby one end portion of said cord can be passed through said passage and secured in said body by flattening said rib at said other side of said body.

2. A jewelry clasp member as defined in claim 1, wherein said one side of said body has a slot formed by punching said rib inwardly of said body, said slot having edges adjacent the rib for engaging said end portion of said cord when said rib is flattened thereat.

3. A jewelry clasp member as defined in claim 2, wherein said U-shaped body is formed from a generally rectangular flat piece of pliable metal by bending said piece along a transverse line intermediate its ends to form said bight and wherein a U-shaped cut is made in said piece at said transverse line to define said tab and wherein said rib is pressed outwardly of said piece near one end edge thereof to define said slots and wherein said hole is defined by said cut when said piece is bent at said line so that said tab separates from said cut.

4. A jewelry clasp member as defined in claim 1, wherein said bight and said other side of said body have a hole adjacent said tab, said hole having sharp edges and being disposed in alignment with said passage, so that a free end of said cord may be passed through said hole and cut off at said sharp edges of said hole after said rib is flattened to secure said end portion of said cord to said body.

5. A jewelry clasp member as defined in claim 4, wherein said tab has another hole therein for receiving and engaging a clasp portion of said other clasp member.

6. A jewelry clasp member as defined in claim 5, wherein said one side of said body has a slot adjacent said rib for engaging said end portion of said cord when said rib is flattened thereat.

7. A jewelry clasp member as defined in claim 4, wherein said tab has a bent end portion defining a hook for engaging a clasp portion of said other clasp member.

8. A jewelry clasp member as defined in claim 7, wherein said one side of said body has a slot adjacent said rib for engaging said end portion of the cord when said rib is flattened thereat.

9. A jewelry clasp member defined in claim 4, wherein said one side of said body has a slot adjacent said rib for engaging said end portion of said cord when said rib is flattened thereat.

* * * * *